US005859585A

United States Patent [19]

Fleming

[11] Patent Number: 5,859,585

[45] Date of Patent: Jan. 12, 1999

[54] PACIFIER LOCATING SYSTEM

[76] Inventor: Renee'R. Fleming, 1545A Arena Rd., Street, Md. 21154

[21] Appl. No.: 771,693

[22] Filed: Dec. 23, 1996

[51] Int. Cl.[6] ..... G08B 1/08

[52] U.S. Cl. ..... 340/539; 340/573; 340/825.36; 340/825.49; 340/825.69; 606/234

[58] Field of Search ..... 340/539, 573, 340/825.36, 825.49, 825.69, 825.72; 606/234; 446/219

[56] References Cited

U.S. PATENT DOCUMENTS

| | | | |
|---|---|---|---|
| 4,476,469 | 10/1984 | Lander | 340/825.49 |
| 4,716,902 | 1/1988 | Swartz | 362/800 |
| 5,204,657 | 4/1993 | Prosser et al. | 340/568 |
| 5,662,685 | 9/1997 | Uhler | 600/234 |

*Primary Examiner*—Donnie L. Crosland

[57] ABSTRACT

A pacifier locating system including a pacifier with receiver circuitry coupled thereto. Such receiver circuitry includes a speaker adapted to emit an audible alarm upon the receipt of a speaker actuation signal. A receiver is electrically connected to a battery and the speaker. The receiver is adapted to transmit to the speaker a speaker actuation signal upon the receipt of a radio activation signal via free space. Also included is a transmitter housing with an interior space. Finally, transmitter circuitry is situated within the interior space and includes an actuation mechanism for selectively transmitting an electric activation signal. The transmitter circuitry further includes a battery situated within the interior space of the transmitter housing for powering purposes. A transmitter is situated within the interior space of the transmitter housing and electrically connected between the battery and the actuation mechanism. In use, the transmitter is adapted to transmit via free space the radio activation signal upon the receipt of the electric activation signal, thereby allowing the speaker to identify the position of the pacifier.

5 Claims, 3 Drawing Sheets

PACIFIER LOCATING SYSTEM

BACKGROUND OF THE INVENTION

1. Field of the Invention

The present invention relates to a pacifier locating system and more particularly pertains to determining the location of a lost pacifier.

2. Description of the Prior Art

The use of locating systems is known in the prior art. More specifically, locating systems heretofore devised and utilized for the purpose of ascertaining the location of various objects are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,101,873 to Anderson; U.S. Pat. No. 4,507,653 to Bayer; U.S. Pat. No. Des. 338,532 to Burgess; U.S. Pat. No. 5,294,915 to Owen; U.S. Pat. No. 5,204,657 to Prosser et al.; and U.S. Pat. No. 5,007,924 to Jekel.

In this respect, the pacifier locating system according to the present invention substantially departs from the conventional concepts and designs of the prior art, and in so doing provides an apparatus primarily developed for the purpose of determining the location of a lost pacifier.

Therefore, it can be appreciated that there exists a continuing need for a new and improved pacifier locating system which can be used for determining the location of a lost pacifier. In this regard, the present invention substantially fulfills this need.

SUMMARY OF THE INVENTION

In view of the foregoing disadvantages inherent in the known types of locating systems now present in the prior art, the present invention provides an improved pacifier locating system. As such, the general purpose of the present invention, which will be described subsequently in greater detail, is to provide a new and improved pacifier locating system which has all the advantages of the prior art and none of the disadvantages.

To attain this, the present invention essentially comprises a pacifier having a bulb portion with a generally spherical configuration. Also included is a flange portion formed of a generally circular plate with a front concave surface and a rear convex surface. A necked portion is integrally coupled at a first end thereof to the bulb portion and further fixed at a second end thereof to a central extent of the front concave surface of the flange portion. As best shown in FIGS. 2–3, the pacifier further has a threaded post coupled to the rear convex surface of the flange portion and extended outwardly therefrom. Further provided is a receiver housing having a central extent with a cylindrical configuration. The central extent of the receiver housing has a front circular face, a rear circular face, and a periphery integrally coupled therebetween defining a closed interior space. The receiver housing further includes an annular closed loop integrally coupled to the rear circular face of the central extent of the receiver housing. A threaded aperture is centrally formed on the front circular face of the receiver housing. By this structure, the threaded post of the pacifier may be releasably coupled to the threaded aperture of the receiver housing. Situated within interior space of the receiver housing is receiver circuitry. As shown in FIG. 6, the receiver circuitry includes a battery and a speaker adapted to emit an audible alarm upon the receipt of a speaker actuation signal. Associated therewith is a receiver electrically connected to the battery and the speaker. Upon the receipt of a radio activation signal via free space, the receiver is adapted to transmit to the speaker a speaker actuation signal. With reference to FIG. 5, a transmitter housing is provided having a rectangular configuration with a top face, a bottom face, and a periphery formed therebetween defining an interior space. For allowing the coupling of a key ring thereto, the transmitter housing further has an eyelet formed on the periphery thereof. Finally, transmitter circuitry is provided, as shown in FIG. 5. The transmitter circuitry includes a light emitting diode situated on the top face of the transmitter housing adapted to emit light upon the actuation thereof. A push button is also situated on the top face of the transmitter housing. The push button is adapted for transmitting an electric activation signal upon the depression thereof. A battery situated within the interior space of the transmitter housing for powering purposes. A transmitter is situated within the interior space of the transmitter housing and electrically connected between the battery, the push button, and the light emitting diode. In operation, the transmitter is adapted to transmit via free space the radio activation signal and further actuate the light emitting diode upon the receipt of the electric activation signal effected by the depression of the push button.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pacifier locating system which has all the advantages of the prior art locating systems and none of the disadvantages.

It is another object of the present invention to provide a new and improved pacifier locating system which may be easily and efficiently manufactured and marketed.

It is a further object of the present invention to provide a new and improved pacifier locating system which is of a durable and reliable construction.

An even further object of the present invention is to provide a new and improved pacifier locating system which is susceptible of a low cost of manufacture with regard to both materials and labor, and which accordingly is then susceptible of low prices of sale to the consuming public, thereby making such pacifier locating system economically available to the buying public.

Still yet another object of the present invention is to provide a new and improved pacifier locating system which provides in the apparatuses and methods of the prior art some of the advantages thereof, while simultaneously overcoming some of the disadvantages normally associated therewith.

Still another object of the present invention is to determine the location of a lost pacifier.

Lastly, it is an object of the present invention to provide a new and improved pacifier locating system including a pacifier with receiver circuitry coupled thereto. Such receiver circuitry includes a speaker adapted to emit an audible alarm upon the receipt of a speaker actuation signal. A receiver is electrically connected to a battery and the speaker. The receiver is adapted to transmit to the speaker a speaker actuation signal upon the receipt of a radio activation signal via free space. Also included is a transmitter housing with an interior space. Finally, transmitter circuitry is situated within the interior space and includes an actuation mechanism for selectively transmitting an electric activation signal. The transmitter circuitry further includes a battery situated within the interior space of the transmitter housing for powering purposes. A transmitter is situated within the interior space of the transmitter housing and electrically connected between the battery and the actuation mechanism. In use, the transmitter is adapted to transmit via free space the radio activation signal upon the receipt of the electric activation signal, thereby allowing the speaker to identify the position of the pacifier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
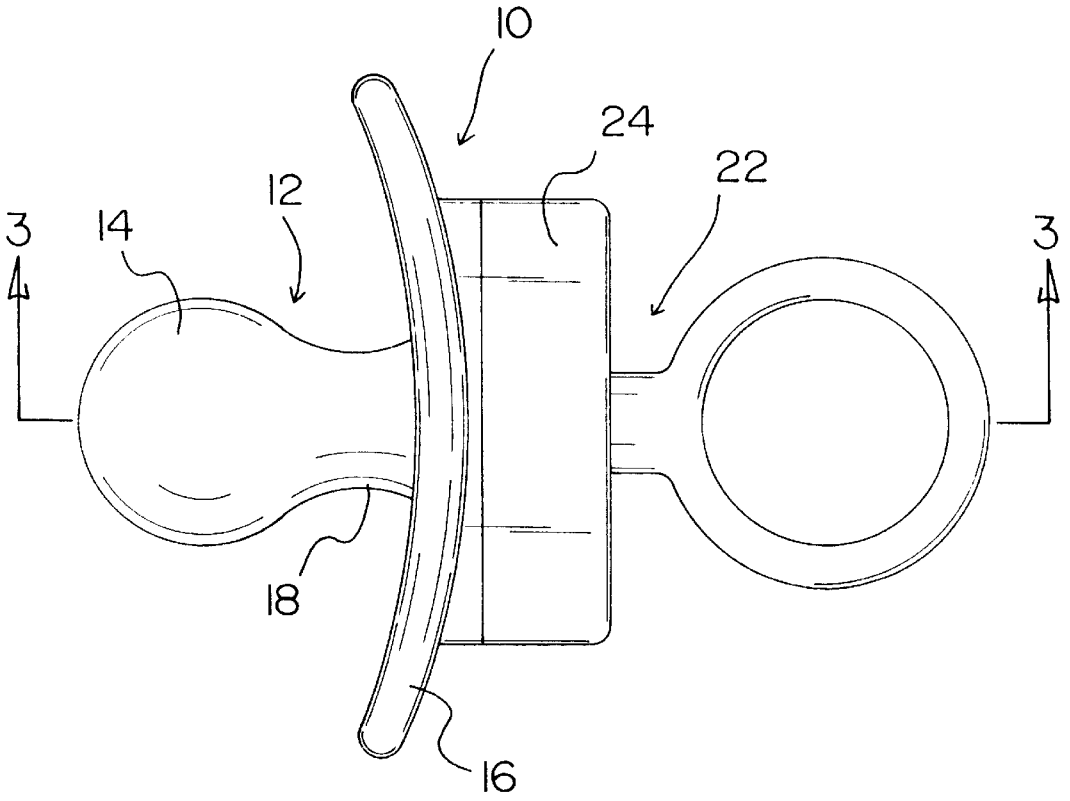
FIG. 1 is a perspective illustration of the preferred embodiment of the pacifier locating system constructed in accordance with the principles of the present invention.

With reference now to the drawings, and in particular to FIG. 1 thereof, a new and improved pacifier locating system embodying the principles and concepts of the present invention and generally designated by the reference numeral 10 will be described.

The present invention, the new and improved pacifier locating system, is comprised of a plurality of components. Such components in their broadest context include a pacifier, a receiver housing, receiver circuitry, a transmitter housing, and transmitter circuitry. Such components are individually configured and correlated with respect to each other so as to attain the desired objective.

Figure 2:
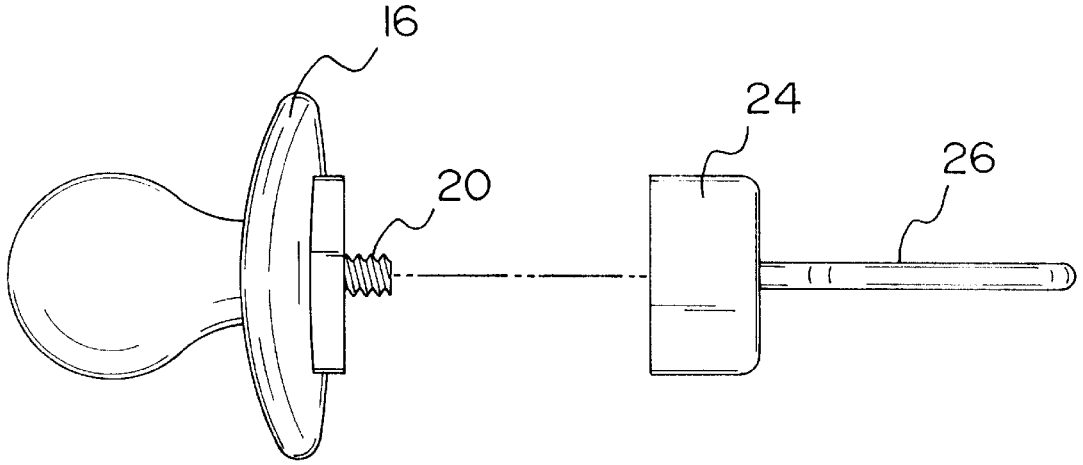
FIG. 2 is an exploded view of the pacifier and receiver housing detached.
Figure 3:
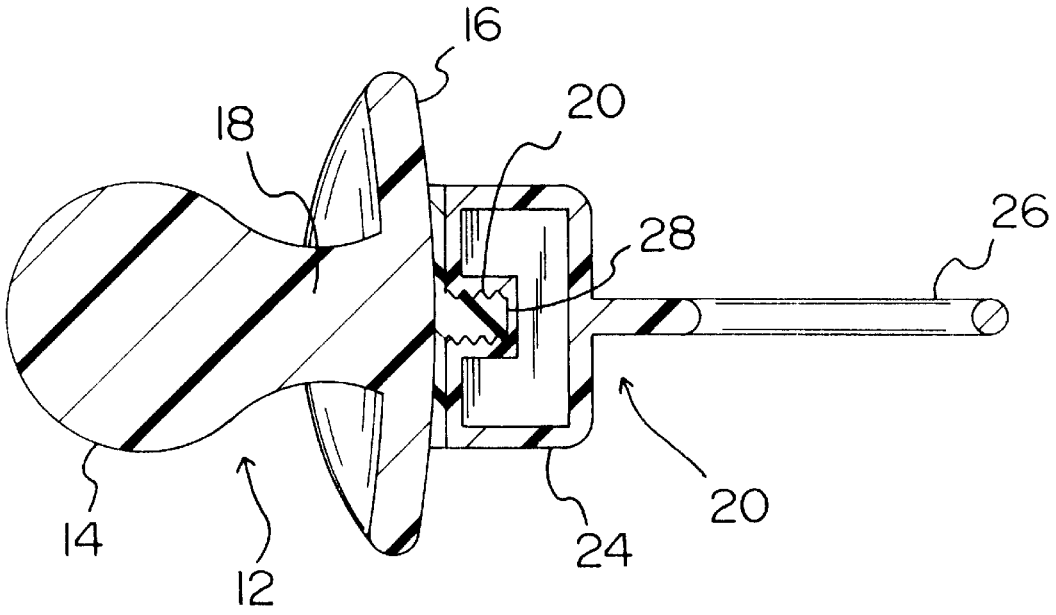
FIG. 3 is a cross-sectional view of the pacifier and receiver housing taken along line 3—3 shown in FIG. 1.
Figure 4:
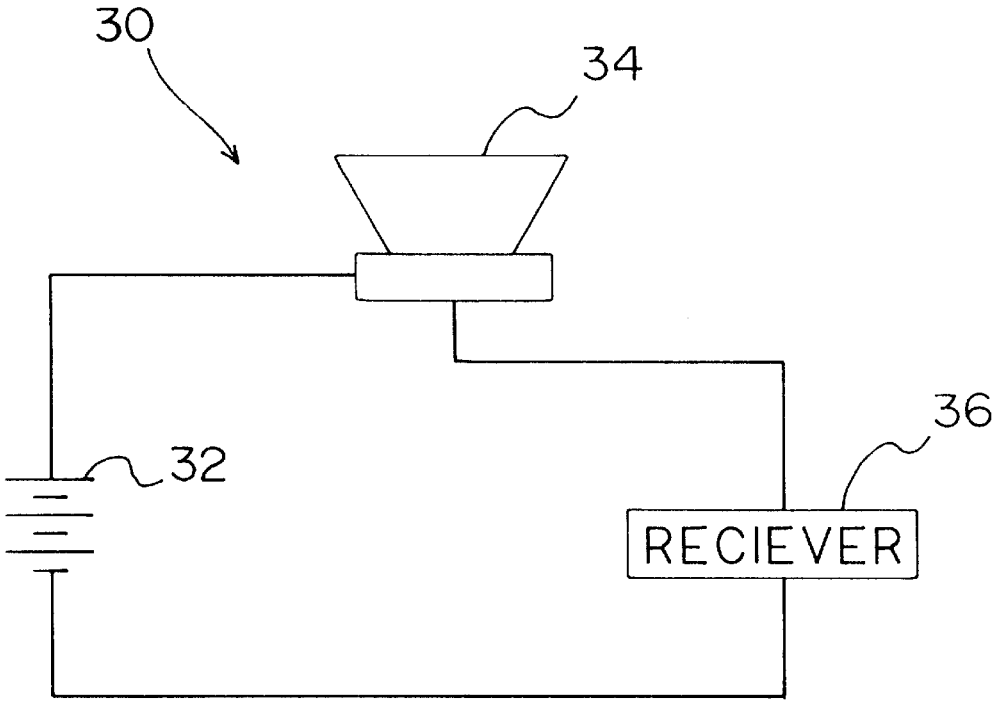
FIG. 4 is a schematic diagram showing the electrical components of the receiver circuitry.

More specifically, it will be noted that the system 10 of the present invention includes a pacifier 12 having a bulb portion 14 with a generally spherical configuration. Also included is a flange portion 16 formed of a generally circular plate with a front concave surface and a rear convex surface. A necked portion 18 is integrally coupled at a first end thereof to the bulb portion and further fixed at a second end thereof to a central extent of the front concave surface of the flange portion. As best shown in FIGS. 2–3, the pacifier further has a threaded post 20 coupled to the rear convex surface of the flange portion and extended outwardly therefrom. Ideally, a rigid disk is coupled between the flange portion and the threaded post, as shown in the Figures.

Further provided is a receiver housing 22 having a central extent 24 with a cylindrical configuration. The central extent of the receiver housing has a front circular face, a rear circular face, and a periphery integrally coupled therebetween defining a closed interior space. Such front circular face is preferably equivalent in size with respect to the disk of the pacifier. The central extent is completely closed to preclude the infiltration of fluids and the like. The receiver housing further includes an annular closed loop 26 integrally coupled to the rear circular face of the central extent of the receiver housing. Preferably, the closed loop is in a fixed perpendicular relationship with the central extent. A threaded aperture 28 is centrally formed on the front circular face of the receiver housing. By this structure, the threaded post of the pacifier may be releasably coupled to the threaded aperture of the receiver housing.

Figure 6:
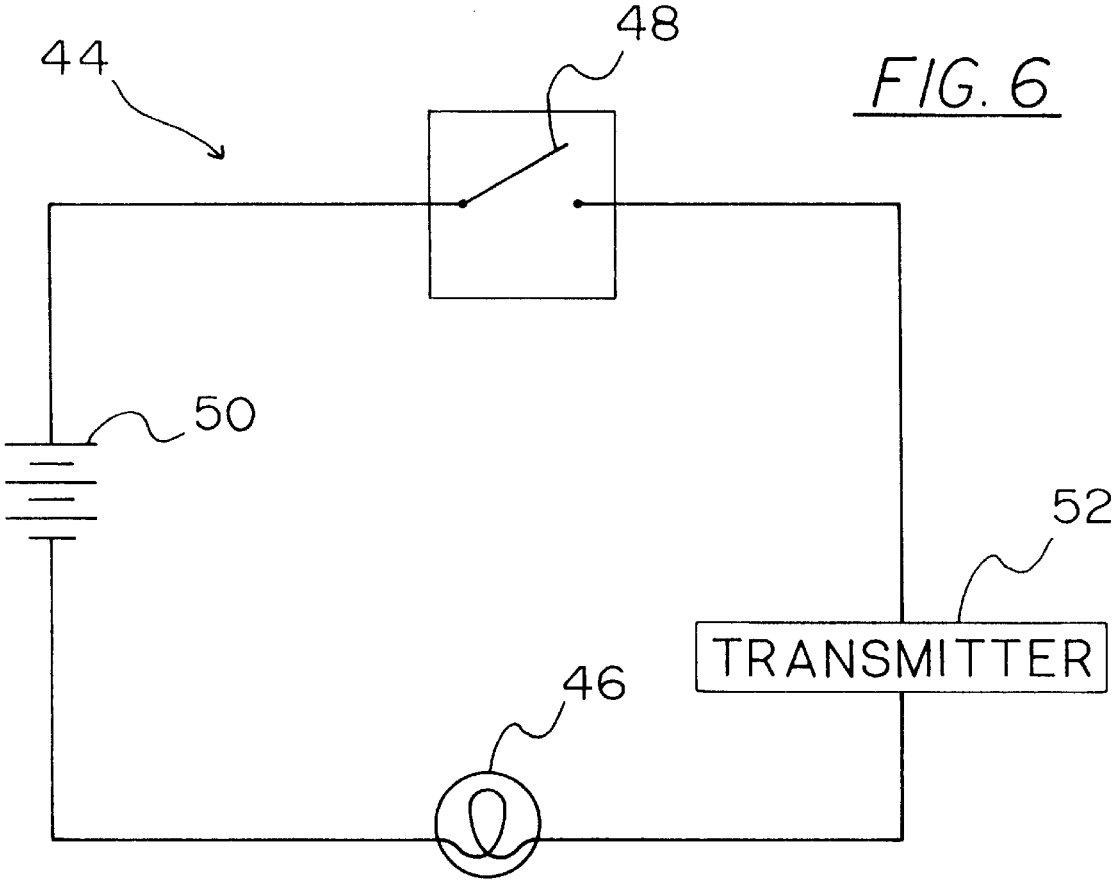
FIG. 6 is a schematic diagram showing the electrical components of the transmitter circuitry.

Situated within interior space of the receiver housing is receiver circuitry 30. As shown in FIG. 6, the receiver circuitry includes a 3V lithium battery 32 and a speaker 34 adapted to emit an audible alarm upon the receipt of a speaker actuation signal. The speaker comprises a piezo transducer. Ideally, the battery is adapted to serve power to the associated circuitry for a period of at least 1–2 years. Associated therewith is a receiver 36 electrically connected to the battery and the speaker. Upon the receipt of a radio activation signal via free space, the receiver is adapted to transmit to the speaker a speaker actuation signal.

Figure 5:
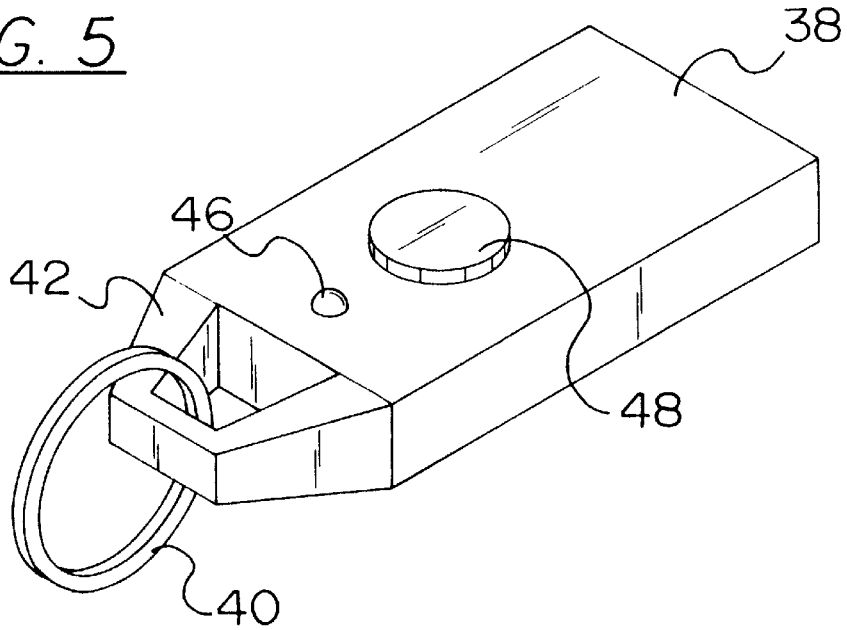
FIG. 5 is a perspective view of the transmitter housing.

With reference to FIG. 5, a transmitter housing 38 is provided having a rectangular configuration with a top face, a bottom face, and a periphery formed therebetween defining an interior space. For allowing the coupling of a key ring 40 thereto, the transmitter housing further has an eyelet 42 formed on the periphery thereof.

Finally, transmitter circuitry 44 is provided, as shown in FIG. 5. The transmitter circuitry includes a light emitting diode 46 situated on the top face of the transmitter housing adapted to emit light upon the actuation thereof. A push button 48 is also situated on the top face of the transmitter housing. The push button is adapted for transmitting an electric activation signal upon the depression thereof. A 12 V battery 50 situated within the interior space of the transmitter housing for powering purposes. A transmitter 52 is situated within the interior space of the transmitter housing and electrically connected between the battery, the push button, and the light emitting diode. In operation, the transmitter is adapted to transmit via free space the radio activation signal and further actuate the light emitting diode upon the receipt of the electric activation signal effected by the depression of the push button.

In an alternate embodiment, the activation signal which is transmitted via free space is an audible signal. As such, the need for the transmitter housing and circuitry is obviated. In use, the receiver of the receiver circuitry is adapted to emit a speaker actuation signal upon the detection of a predetermined audible sound such as a clap or key spoken phrase.

In use, the a user may determine the location of a lost pacifier by simply depressing the push button of the transmitter circuitry. The light emitting diode is adapted to emit a signal upon the depression of the push button to verify the transmission of the radio activation signal. The receiver housing is adapted to be separated from the pacifier when the pacifier is being sterilized at high temperatures.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved pacifier locating system comprising, in combination:

a pacifier having a bulb portion with a generally spherical configuration, a flange portion formed of a generally circular plate with a front concave surface and a rear convex surface, and a necked portion integrally coupled at a first end thereof to the bulb portion and further fixed at a second end thereof to a central extent of the front concave surface of the flange portion, the pacifier further having threaded post coupled to the rear convex surface of the flange portion and extending outwardly therefrom;

a receiver housing having a central extent with a cylindrical configuration having a front circular face, a rear circular face, and a periphery integrally coupled therebetween defining a closed interior space, the receiver housing further including an annular closed loop integrally coupled to the rear circular face of the central extent thereof and also a threaded aperture centrally formed on the front circular face thereof, whereby the threaded post of the pacifier may be releasably coupled to the threaded aperture of the receiver housing;

receiver circuitry situated within interior space of the receiver housing including a battery, a speaker adapted to emit an audible alarm upon the receipt of a speaker actuation signal, and a receiver electrically connected to the battery and the speaker, the receiver adapted to transmit to the speaker a speaker actuation signal upon the receipt of a radio activation signal via free space;

a transmitter housing having a rectangular configuration with a top face, a bottom face, and a periphery formed therebetween defining an interior space, the transmitter housing further having an eyelet formed on the periphery thereof for allowing the coupling of a key ring thereto; and transmitter circuitry including a light emitting diode situated on the top face of the transmitter housing adapted to emit light upon the actuation thereof, a push button situated on the top face of the transmitter housing for transmitting an electric activation signal upon the depression thereof, a battery situated within the interior space of the transmitter housing for powering purposes, and a transmitter situated within the interior space of the transmitter housing and electrically connected between the battery, the push button, and the light emitting diode, the transmitter adapted to transmit via free space the radio activation signal and further actuate the light emitting diode upon the receipt of the electric activation signal effected by the depression of the push button.

2. A pacifier locating system comprising:

a pacifier;

receiver circuitry coupled to the pacifier including a battery, a speaker adapted to emit an audible alarm upon the receipt of a speaker actuation signal, and a receiver electrically connected to the battery and the speaker, the receiver adapted to transmit to the speaker a speaker actuation signal upon the receipt of a radio activation signal via free space;

a transmitter housing with an interior space; and transmitter circuitry including actuation means for selectively transmitting an electric activation signal, a battery situated within the interior space of the transmitter housing for powering purposes, and a transmitter situated within the interior space of the transmitter housing and electrically connected between the battery and the actuation means, the transmitter adapted to transmit via free space the radio activation signal upon the receipt of the electric activation signal;

wherein the receiver circuitry is situated within a receiver housing which is in turn removably coupled to the pacifier.

3. A pacifier locating system as set forth in claim 2 wherein the pacifier has a bulb portion with a generally spherical configuration, a flange portion formed of a generally circular plate with a front concave surface and a rear convex surface, and a necked portion integrally coupled at a first end thereof to the bulb portion and further fixed at a second end thereof to a central extent of the front concave surface of the flange portion, the pacifier further having threaded post coupled to the rear convex surface of the flange portion and extending outwardly therefrom.

4. A pacifier locating system as set forth in claim 3 wherein the receiver housing has a central extent with a cylindrical configuration having a front circular face, a rear circular face, and a periphery integrally coupled therebetween defining a closed interior space, the receiver housing further including an annular closed loop integrally coupled to the rear circular face of the central extent thereof and also a threaded aperture centrally formed on the front circular face thereof, whereby the threaded post of the pacifier may be releasably coupled to the threaded aperture of the receiver housing.

5. A pacifier locating system as set forth in claim 2 and further comprising a light emitting diode situated on the transmitter housing adapted to emit light upon the actuation thereof, whereby the light emitting diode is actuated upon the transmission of the radio activation signal from the transmitter.

* * * * *